US010905937B2

(12) United States Patent
Heil et al.

(10) Patent No.: US 10,905,937 B2
(45) Date of Patent: Feb. 2, 2021

(54) REINFORCING FRAME FOR A SKI

(71) Applicant: Völkl Sports GmbH, Straubing (DE)

(72) Inventors: Tobias Heil, Mitterfels (DE); Dominik Grunert, Mitterfels (DE)

(73) Assignee: Völkl Sports GmbH, Straubing (DE)

( * ) Notice: Subject to any disclaimer, the term of this patent is extended or adjusted under 35 U.S.C. 154(b) by 0 days.

(21) Appl. No.: 16/223,669

(22) Filed: Dec. 18, 2018

(65) Prior Publication Data

US 2019/0381387 A1 Dec. 19, 2019

(30) Foreign Application Priority Data

Jun. 18, 2018 (DE) ..... 20 2018 103 415 U

(51) Int. Cl.
*A63C 5/052* (2006.01)
*A63C 5/12* (2006.01)

(52) U.S. Cl.
CPC ..... *A63C 5/052* (2013.01); *A63C 5/124* (2013.01); *A63C 5/126* (2013.01); *A63C 5/128* (2013.01)

(58) Field of Classification Search
CPC ..... A63C 5/04–056
See application file for complete search history.

(56) References Cited

U.S. PATENT DOCUMENTS 2,361,030 A * 10/1944 Hohmann ..... A63C 5/048 280/608
3,329,437 A * 7/1967 Holmberg ..... A63C 5/04 280/610
4,165,886 A * 8/1979 Nussbaumer ..... A63C 5/04 280/604
8,827,301 B2 * 9/2014 Vailli ..... A63C 5/006 280/601
9,744,430 B2 * 8/2017 Hill ..... B32B 15/20
2004/0135347 A1 * 7/2004 Marion ..... A63C 5/03 280/610
2005/0212257 A1 * 9/2005 Deborde ..... A63C 5/03 280/601
2006/0110993 A1 * 5/2006 Yeh ..... A63C 5/056 441/74
2008/0029999 A1 * 2/2008 Lee ..... A63C 5/052 280/609
2008/0054578 A1 * 3/2008 Lee ..... A63C 5/052 280/14.21
2009/0134590 A1 * 5/2009 Largueze ..... A63C 5/003 280/14.21
2010/0187795 A1 * 7/2010 Binder ..... A63C 5/006 280/601
2011/0001304 A1 * 1/2011 Dutaut ..... A63C 5/006 280/601
2011/0272920 A1 * 11/2011 Adamczewski ..... A63C 5/03 280/601
2015/0335985 A1 * 11/2015 Schenck ..... A63C 5/122 280/610
2016/0114240 A1 * 4/2016 Kim ..... A63C 5/12 280/609

* cited by examiner

*Primary Examiner* — Erez Gurari
(74) *Attorney, Agent, or Firm* — RatnerPrestia

(57) ABSTRACT

The invention relates to a ski, including: a paddle region which forms a front end of the ski; a rear end region; and a binding region, which extends in the longitudinal direction of the ski between the paddle region and the rear end region, for fastening a ski binding; a core; an upper strap; a lower strap; and a reinforcing frame which extends in the paddle region and/or in the rear end region.

24 Claims, 3 Drawing Sheets

REINFORCING FRAME FOR A SKI

CROSS REFERENCE TO RELATED APPLICATION

This application claims priority to German Patent Application No. 20 2018 103 415.4, filed Jun. 18, 2018, the contents of such application being incorporated by reference herein.

FIELD OF THE INVENTION

The invention relates to a ski, comprising: a paddle region which forms a front end of the ski; a rear end region; and a binding region, which extends in the longitudinal direction of the ski between the paddle region and the rear end region, for fastening a ski binding. The ski also comprises a core, an upper strap, a lower strap, and a reinforcing frame which extends in the paddle region and/or in the rear end region.

BACKGROUND

Providing reinforcing layers in the layered structure of a ski, which generally extend above and/or below the wooden core, in order to improve the travelling properties of the ski during descent, in particular in difficult terrain, is known in the prior art. Such reinforcing layers can improve the ski's smoothness of travel and torsion or torsional stiffness, without negatively affecting the so-called flex of the ski. Aluminium alloys, fibre-composite materials or the like have for example proven suitable as materials for said reinforcing layer. One disadvantage of these "layer solutions" is the relatively large additional weight which this adds to the ski. Modern skiers, whether they are ski tourers, downhill skiers or free-riders, pay attention to the weight of their sports equipment, which is now a noted factor when deciding whether or not to buy a ski.

SUMMARY OF THE INVENTION

An aspect of the invention is a ski which exhibits the described advantages, while however exhibiting a lower weight. Another object is to provide an element which is to be fitted in the ski.

One aspect of the invention relates to a ski, preferably a ski which can be used equally for downhill or cross-country, wherein the ski comprises a paddle region, which forms a front end of the ski, and a rear end region. A binding region, for fastening a ski binding on the ski, extends in the longitudinal direction of the ski between the paddle region and the rear end region.

The ski also comprises a core, an upper strap, a lower strap, and a reinforcing frame which extends in the paddle region and/or in the rear end region.

The reinforcing frame is in particular a frame-shaped layer made of a film material and/or plate material and/or made of a fibre-composite material. The reinforcing frame is substantially a flat body which forms all or part of a layer but does not protrude beyond an exterior side of the finished ski and does not comprise any lateral bending edges which are for example aligned obliquely or perpendicularly with respect to the surface of a ski. The reinforcing frame can however also be designed in multiple layers. The reinforcing frame can for example be cut or punched out of the film or plate material. An overall area in a plan view onto the reinforcing frame is smaller than a corresponding overall area of the ski or a corresponding overall area of a layer of material which forms part of the ski. This has a positive effect on the overall weight of the ski.

In the frame technology claimed, the reinforcing material can be concentrated where it will have a decisive effect in favour of the intended characteristics of the ski. A transmission of force is not required in the middle of the ski to the same extent as in the exterior regions or edge regions in front of and behind the binding region, i.e. in the paddle region and rear end region of the ski, respectively. Receding this region ensures the desired reduction in the overall weight of the ski and moreover an improved combination of agility and stability at speed in the ski.

The reinforcing frame can comprise: a left-hand side limb which extends in the longitudinal direction of the ski; a right-hand side limb which extends in the longitudinal direction of the ski; and a transverse limb which extends transverse to the longitudinal direction of the ski and connects the right-hand side limb and the left-hand side limb. The side limbs can be spaced from each other transverse to the longitudinal direction of the ski; in other words, they can exhibit a limb distance from each other transverse to the longitudinal direction of the ski.

The right-hand side limb can have a width, transverse to the longitudinal direction of the ski, which is smaller than the limb distance. The same applies to the left-hand side limb. The width of the right-hand side limb can preferably be equal to the width of the left-hand side limb. A sum of the width of the left-hand side limb and the width of the right-hand side limb in any sectional line transverse to the longitudinal direction of the ski can be equal to, larger than or smaller than the limb distance, at least in most of the reinforcing frame.

The side limb distance can be constant, at least over most of the length of the reinforcing frame. The width of the right-hand side limb and the width of the left-hand side limb can decrease, preferably continuously, from a front end of the paddle region or, respectively, a front end of the transverse limb formed in the paddle region, towards the binding region.

The left-hand side limb can extend along the left-hand side edge of the ski, starting from the transverse limb, and the right-hand side limb can extend along the right-hand side edge of the ski, starting from the transverse limb. In a plan view onto the reinforcing frame, the transverse limb can form the tip of the paddle region of the ski or the rear end of the ski.

The left-hand side limb and the right-hand side limb preferably extend from the transverse limb towards the binding region, at most up to or up to and into the binding region. The binding region or binding fastening region of the ski extends in the longitudinal direction of the ski up to and below a front jaw and a rear jaw of the ski binding which is fastened on the ski, i.e. the right-hand side limb and the left-hand side limb can terminate before or at the beginning of the binding region, as viewed from the transverse limb.

The reinforcing frame can consist of at least a first or front reinforcing frame part for the paddle region of the ski, and a second or rear reinforcing frame part for the rear end region of the ski. The front reinforcing frame part and the rear reinforcing frame part are preferably not connected to each other. The two reinforcing frame parts are also not in contact, such that the weight of the split reinforcing frame is further reduced as compared to a circumferential reinforcing frame.

One or both of the reinforcing frame parts can be substantially horseshoe-shaped or U-shaped, wherein the open end of the horseshoe-shaped front reinforcing frame part and the open end of the horseshoe-shaped rear reinforcing frame part lie opposite each other on the ski in the longitudinal direction of the ski.

In a joined ski, the reinforcing frame can be arranged above the core and/or can encompass or frame the core at or near an upper end which faces away from a lower side of the ski. If the ski has a multi-layered structure, the front reinforcing frame part and the rear reinforcing frame part can form a layer of their own or can be assigned to a single layer or to different layers. The reinforcing frame or, respectively, the front reinforcing frame part or rear reinforcing frame part can thus be arranged above a first upper strap as viewed from the core, wherein the reinforcing frame preferably overlaps the core at least in the region of the two side limbs.

An extent of the front reinforcing frame part in the longitudinal direction of the ski can be larger than an extent of the rear reinforcing frame part in the longitudinal direction of the ski.

As already described above, the reinforcing frame can be or comprise a film material, a plate material or a fibre-composite material. The reinforcing frame can exhibit a substantially constant thickness over its entire extent.

The reinforcing frame can for example be a light metal frame made of a light metal film having a thickness of at most 1.2 mm, preferably at most 0.7 mm. The light metal film can exhibit a thickness of at least 0.2 mm. The light metal frame can exhibit a constant thickness over its entire extent, as measured substantially perpendicular to a travelling surface of the ski. The thickness of the light metal frame can alternatively change, continuously or incrementally, in at least one region.

The light metal can be an aluminium alloy, in particular a high-tensile aluminium alloy comprising titanium as a constituent.

The reinforcing frame can alternatively consist of a fibre-composite material consisting of one or more identical or different fibre layers.

The reinforcing frame can also be designed in multiple layers and for example comprise a layer made of light metal and a layer made of a fibre-composite material. Lastly, the layer made of light metal can also be enveloped by the fibre-composite material or embedded in the fibre-composite material, wherein the layer made of light metal and the layer made of the fibre-composite material can exhibit different shapes or contours which overlap only in regions, such that the finished reinforcing frame comprises regions which comprise light metal only, regions which are formed solely by the fibre-composite material, and regions which are formed from the light metal and the fibre-composite material.

The core can be a wooden core which can comprise a reinforcement made for example of a fibreglass.

In the binding region, which—as has already been described—can be arranged between the front reinforcing frame part and the rear reinforcing frame part in the longitudinal direction of the ski, the ski can be designed to accommodate a ski binding. A reinforcing plate, for example a light metal plate, can then be arranged in the binding region, for example above the core and below a first upper strap, for reinforcing purposes. This reinforcing plate can be a plate made of an aluminium alloy and can preferably exhibit a thickness which is smaller than or equal to the thickness of the reinforcing frame or light metal frame. It is preferable for the reinforcing frame and the reinforcing plate, when fitted in the ski, to not overlap or to only slightly overlap in a plan view from above onto the ski.

The front paddle region and the rear end region of the ski can comprise a lightweight carbon material in order to achieve the necessary stiffness and elasticity while keeping the overall weight of the ski low. In a side view, the ski can be shaped like an elongated W in the longitudinal direction of the ski; in other words, from the front or rear end, it can have a convex curve followed by a concave curve followed by a convex curve, i.e. rocker/camber/rocker, wherein for the purposes of the application, "convex" means that an apex of the convex curve lies on a flat plane when a ski is lying on the plane, while an apex of the concave curve is spaced from the area of contact. The concave region on the ski can be formed in the region below the binding. A midsection is generally also formed in the concave region of the ski. A midsection width of a classic Alpine and/or free-ride ski can measure about 60 mm to 140 mm.

A second aspect of the invention relates to a reinforcing frame for a ski which can be punched or cut out of a light metal film or light metal plate, in particular a high-tensile aluminium alloy, or formed from a fibre-composite material, or which comprises at least one of these materials.

The reinforcing frame forms at least a paddle region and/or rear end region of the finished ski or reinforces the paddle region and/or rear end region. The reinforcing frame can comprise a front reinforcing frame part and a separate rear reinforcing frame part, wherein both reinforcing frame parts can be formed substantially in the shape of a horseshoe.

The reinforcing frame can in particular be a reinforcing frame such as has been described in detail with respect to the first aspect.

BRIEF DESCRIPTION OF THE DRAWING

In the following, an example of a reinforcing frame and an example of a position of the reinforcing frame layer within the structure of the ski are described on the basis of figures, without restricting the invention to the examples shown. Features essential to aspects of the invention which can only be gathered from the figures form part of the scope of the disclosure and can advantageously develop the subject-matter of aspects of the invention, individually or in combinations shown.

The figures show.

DETAILED DESCRIPTION OF THE PREFERRED EMBODIMENTS

Figure 1:
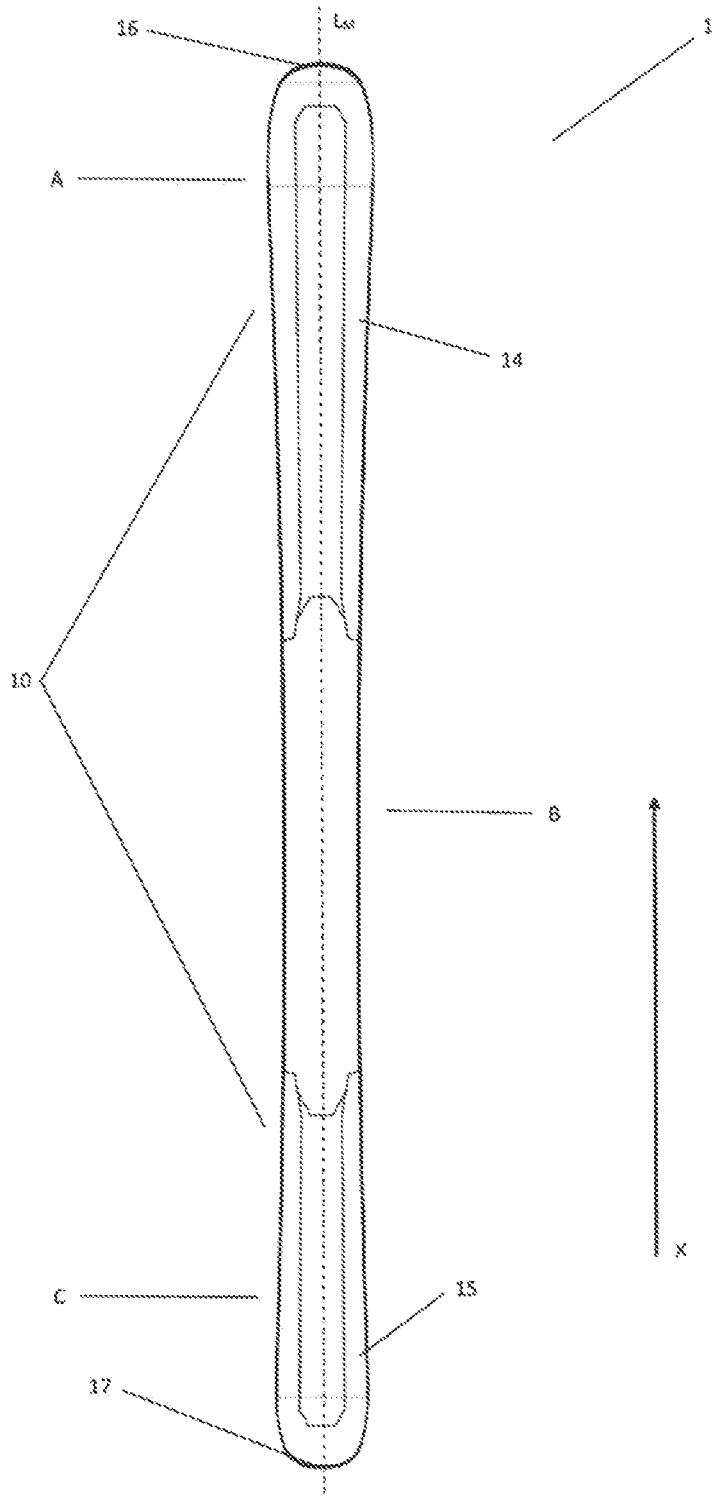
FIG. 1 an example embodiment of a reinforcing frame.

FIG. 1 shows a ski 1 in a plan view from above. The ski 1 comprises a front paddle region A, a middle or binding region B on which a ski binding (not shown) can be fitted, and a rear end region C.

The ski 1 comprises a reinforcing frame 10 which in the example embodiment shown comprises a front reinforcing frame part 14 and a separate rear reinforcing frame part 15. The front reinforcing frame part 14 and the rear reinforcing frame part 15 are each formed in the shape of a horseshoe or in the shape of a U, wherein the open sides of the horseshoes or Us lie opposite each other on the ski in the longitudinal direction X of the ski.

Other than as shown in the example embodiment, the reinforcing frame 10 can form a closed frame, or the reinforcing frame 10 is formed solely by the front reinforcing frame part 14 or solely by the rear reinforcing frame part 15.

The front reinforcing frame part 14 and the rear reinforcing frame part 15 extend in the longitudinal direction X of the ski 1 from a tip 16 of the ski or, respectively, an end 17 of the ski up to and onto or into the binding region B. The front reinforcing frame part 14 and the rear reinforcing frame part 15 do not overlap.

In the example embodiment, an extent of the front reinforcing frame part 14 in the longitudinal direction X of the ski is larger than a corresponding extent of the rear reinforcing frame part 15. In other examples of reinforcing frames (not shown), the extent of the two reinforcing frame parts 14, 15 in the longitudinal direction X of the ski can be equal, or the extent of the rear reinforcing frame part 15 can be larger than the extent of the front reinforcing frame part 14.

The reinforcing frame 10 can for example be a light metal frame made of a high-tensile aluminium alloy, or the reinforcing frame 10 can be formed from another material or from a composite structure which comprises multiple layers of material. One of these layers of material in the composite structure can be a layer made of a light metal film, and another layer can be made of a fibre-composite material. This other material can likewise form a layer of the composite structure from which the reinforcing frame 10 is formed.

The front reinforcing frame part 14 and the rear reinforcing frame part 15 can also exhibit a different structure or can be formed from different materials. The front reinforcing frame part 14 can thus for example be produced exclusively from a light metal, whereas the rear reinforcing frame part 15 can be produced exclusively from carbon or from a composite structure, and vice versa.

Figure 2:
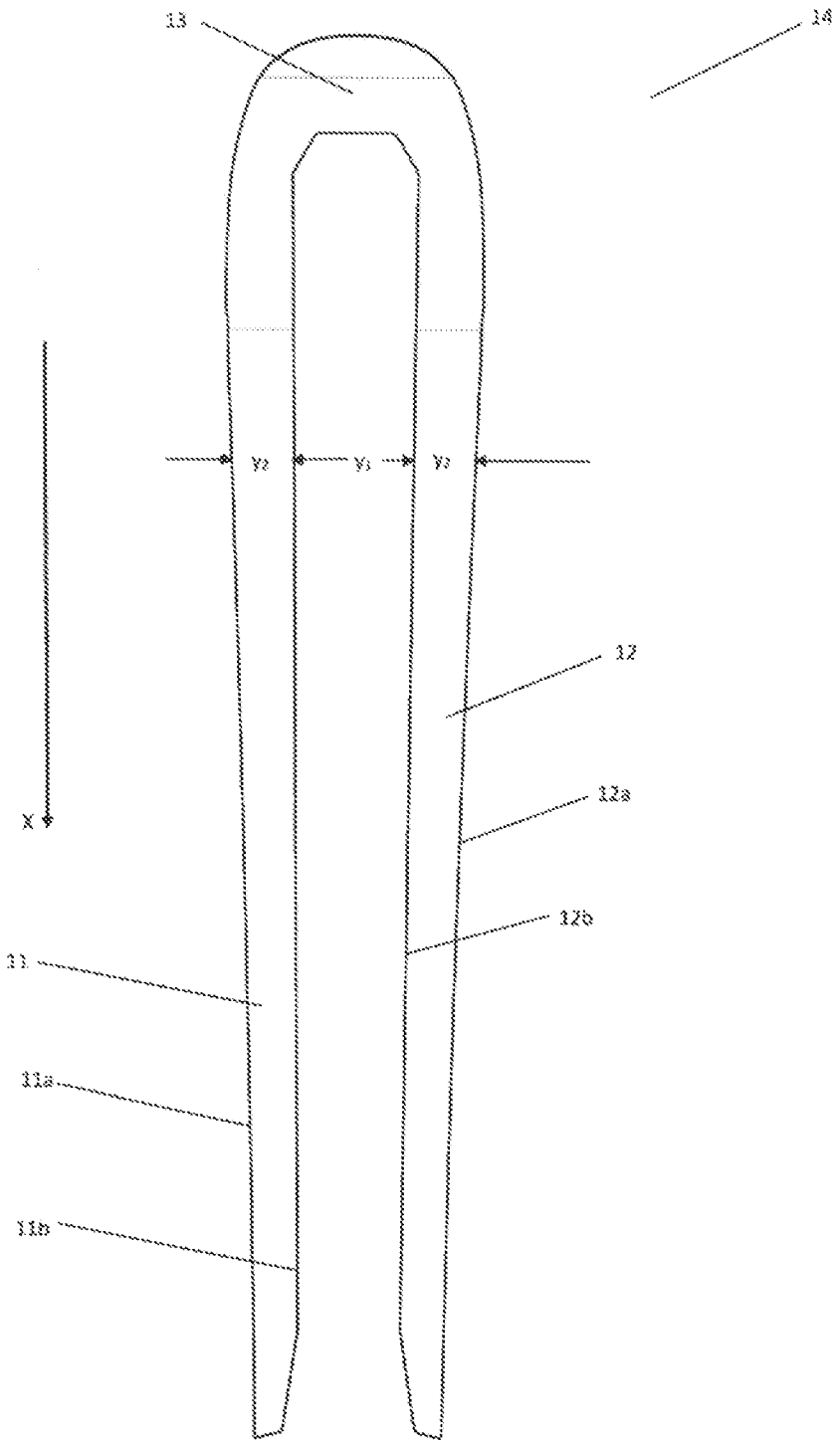
FIG. 2 a front reinforcing frame part of the reinforcing frame of FIG. 1.

FIG. 2 shows the front reinforcing frame part 14 of the reinforcing frame 10, separated off from the ski 1, as a semi-finished product such as can for example be stored in a warehouse for further processing. All of the following description of the front reinforcing frame part 14 applies mutatis mutandis to the rear reinforcing frame part 15 which is not shown in FIG. 2. The following description does not therefore distinguish between the front reinforcing frame part 14 and the rear reinforcing frame part 15 but rather describes a reinforcing frame part 14, 15 in general.

The reinforcing frame part 14, 15 comprises side limbs 11, 12, which extend in the longitudinal direction X of the ski, and a transverse limb 13 which connects the side limbs 11, 12 and forms all or part of a front end 16 or, respectively, a rear end 17 of the ski 1 (not shown).

The side limbs 11, 12 are a left-hand side limb 11 and a right-hand side limb 12 which together with the transverse limb 13 form the horseshoe-shaped reinforcing frame part 14, 15. The left-hand side limb 11 and the right-hand side limb 12 are designed identically and, in the example embodiment, mirror-inverted with respect to a plane which is perpendicular to a plane which spans a surface of the reinforcing frame part 14, 15 and includes a central longitudinal axis $L_M$ (see FIG. 1) of the reinforcing frame part 14, 15.

The left-hand side limb 11 and the right-hand side limb 12 each comprise an exterior edge 11*a* and 12*a* and an interior edge 11*b* and 12*b*. The interior edges 11*b*, 12*b* extend substantially parallel to each other and exhibit a distance $y_1$ from the interior edge 11*b* to the interior edge 12*b*. A width $y_2$ of the side limbs 11, 12 changes continuously along their axial extent, wherein in the example embodiment, the width $y_2$ constantly decreases in the direction of axial extent of the side limbs 11, 12, over a majority of said extent, starting at or near the transverse limb 13.

The width $y_2$ of the side limbs 11, 12 is identical in any section transverse to the central longitudinal axis $L_M$ of the reinforcing frame part 14, 15, wherein in the example embodiment, the distance $y_1$ is larger than the width $y_2$ of one of the side limbs 11, 12 and preferably larger than the sum of the widths $y_2$ of the left-hand side limb 11 and the right-hand side limb 12 or, in other words, larger than $2 \times y_2$, at all points.

Figure 3:
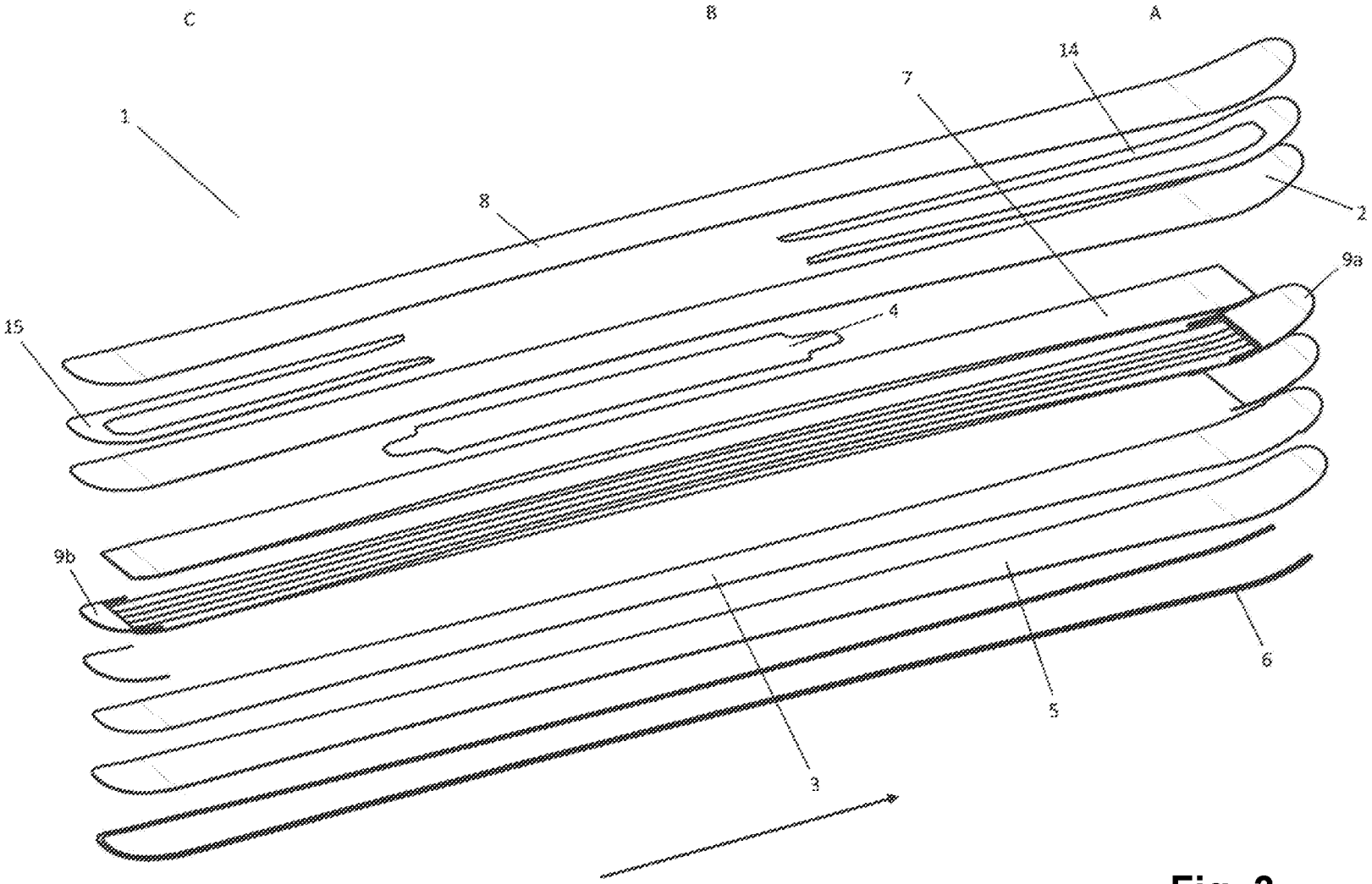
FIG. 3 an example of a layered structure of a ski.

FIG. 3 shows an exploded representation of an example of a ski 1, comprising all the layers which are joined together to form the finished ski 1. In order to describe aspects of the invention, it is not necessary to define and describe all the layers shown in the example.

Starting from the bottom, FIG. 3 shows: edges 6; a travelling surface layer 5; a lower strap 3; an intermediate layer; a paddle part 9*a* in the region A of the ski 1 and an end part 9*b* in the region C of the ski 1, made for example of carbon; a core 7; a reinforcing plate 4 in the region B of the ski 1, for the ski binding; an upper strap 2; the reinforcing frame 10 consisting of the front reinforcing frame part 14 and the rear reinforcing frame part 15; and lastly, a cover 8 which forms an upper side of the ski 1. The cover 8 can be transparent, at least in regions, such that the reinforcing frame 10 can form a design element in the finished ski 1.

As shown in the example, the reinforcing frame 10 can be arranged directly below the cover 8 and above the core 7. The reinforcing frame 10 can itself form a part of the cover 8 or can be arranged below the upper strap 2 but above the core 7. If the reinforcing frame 10 itself forms part of the cover 8, the reinforcing frame 10 can comprise a protective coating made of a clear varnish or similar material, in order to maintain an appealing visual appearance of the surface of the ski 1 for as long as possible. The reinforcing frame 10 itself can also comprise a surface which can be printed on, such that for example a brand name, logo or other information can be printed directly onto the reinforcing frame 10.

Other than as shown in the example in FIG. 3, the front reinforcing frame part 14 and the rear reinforcing frame part 15 can also be assigned to different layers. One of the reinforcing frame parts 14, 15 can then be arranged above the upper strap 2, and the other below or next to the upper strap 2, which in this case would comprise a corresponding cropped region. If a reinforcing frame part 14, 15 is arranged next to the upper strap 2 within this sense, it effectively forms a part of the layer of the upper strap 2 in the structure of the ski shown.

LIST OF REFERENCE SIGNS

1 ski
2 upper strap
3 lower strap
4 reinforcing plate
5 travelling surface layer
6 edges
7 core
8 cover
9*a* paddle
9*b* end region
10 reinforcing frame
11 side limb
12 side limb
13 transverse limb
14 front reinforcing frame part

15 rear reinforcing frame part
16 front end
17 rear end
A paddle region
B binding region
C rear end region
X longitudinal direction of the ski
$L_M$ longitudinal centre axis of the reinforcing frame
$y_1$ distance
$y_2$ width

The invention claimed is:

1. A ski, comprising:
(a) a paddle region which forms a front end of the ski; a rear end region; and a binding region, which extends in the longitudinal direction of the ski between the paddle region and the rear end region, for fastening a ski binding;
(b) a core;
(c) running edges;
(d) an upper strap;
(e) a lower strap; and a reinforcing frame which extends in the paddle region and/or in the rear end region,
(f) wherein the reinforcing frame comprises: a left-hand side limb which extends in the longitudinal direction of the ski; a right-hand side limb which extends in the longitudinal direction of the ski; and a transverse limb which extends transverse to the longitudinal direction of the ski and connects the side limbs, and wherein the side limbs exhibit a limb distance from each other transverse to the longitudinal direction of the ski, and
(g) wherein at least a part of the reinforcing frame is made of metal, and
(h) wherein the limb distance is constant over at least most of the length of the reinforcing frame.

2. The ski according to claim 1, wherein the side limbs each have a width, transverse to the longitudinal direction of the ski, which is smaller than the limb distance.

3. The ski according to claim 1, wherein the side limbs each have a width, transverse to the longitudinal direction of the ski, which decreases towards the binding region.

4. The ski according to claim 1, wherein the left-hand side limb extends along the left-hand side edge of the ski, starting from the transverse limb, and the right-hand side limb extends along the right-hand side edge of the ski, starting from the transverse limb.

5. The ski according to claim 1, wherein in a plan view onto the reinforcing frame, the transverse limb forms the tip or rear end of the ski.

6. The ski according to claim 1, wherein the side limbs extend from the transverse limb towards the binding region, at most up to or up to and into the binding region, wherein the binding region extends in the longitudinal direction of the ski up to and below a front jaw and a rear jaw of the ski binding, when the ski binding is fastened.

7. The ski according to claim 6, wherein the side limbs terminate axially before the binding region, as viewed from the transverse limb.

8. The ski according to claim 1, wherein the reinforcing frame comprises a film material, a plate material and/or a fibre-composite material.

9. The ski according to claim 1, wherein the reinforcing frame comprises a front reinforcing frame part for the paddle region, and a rear reinforcing frame part for the rear end region.

10. The ski according to claim 9, wherein the front reinforcing frame part and the rear reinforcing frame part are not connected to each other and do not overlap.

11. The ski according to claim 9, wherein a length of an extent of the front reinforcing frame part in the longitudinal direction of the ski and a length of the extent of the rear reinforcing frame part in the longitudinal direction of the ski differ in size.

12. The ski according to claim 1, wherein the reinforcing frame is arranged above the core.

13. The ski according to claim 12, wherein a length of an extent of the front reinforcing frame part in the longitudinal direction of the ski and a length of the extent of the rear reinforcing frame part in the longitudinal direction of the ski differ in size.

14. The ski according to claim 1, wherein the reinforcing frame is a light metal frame made of an aluminium alloy.

15. The ski according to claim 14, wherein the light metal frame has a thickness of at most 1.2 mm.

16. The ski according to claim 14, wherein the light metal frame has a thickness of at least 0.2 mm.

17. The ski according to claim 14, wherein the light metal frame has a thickness of at most 0.7 mm.

18. The ski according to claim 1, wherein the reinforcing frame comprises a fibre-composite material.

19. The ski according to claim 18, wherein the fibre-composite material is formed from carbon, glass, aramid, stone (for example basalt), natural fibre (for example bamboo), plastic (for example thermoplastics) and/or ceramics.

20. The ski according to claim 1, wherein the reinforcing frame forms part of at least a paddle region and a rear end region of the finished ski.

21. The ski according to claim 1, wherein the side limbs each have a width, transverse to the longitudinal direction of the ski, which decreases continuously towards the binding region.

22. A ski, comprising:
(a) a paddle region which forms a front end of the ski; a rear end region; and a binding region, which extends in the longitudinal direction of the ski between the paddle region and the rear end region, for fastening a ski binding;
(b) a core;
(c) running edges;
(d) an upper strap;
(e) a lower strap; and a reinforcing frame which extends in the paddle region and/or in the rear end region,
(f) wherein the reinforcing frame comprises: a left-hand side limb which extends in the longitudinal direction of the ski; a right-hand side limb which extends in the longitudinal direction of the ski; and a transverse limb which extends transverse to the longitudinal direction of the ski and connects the side limbs, and wherein the side limbs exhibit a limb distance from each other transverse to the longitudinal direction of the ski, and
(g) wherein at least a part of the reinforcing frame is made of metal, and
(h) wherein the reinforcing frame exhibits a substantially constant thickness over its entire extent.

23. A ski comprising:
(a) a paddle region which forms a front end of the ski; a rear end region; and a binding region, which extends in the longitudinal direction of the ski between the paddle region and the rear end region, for fastening a ski binding;
(b) a core;
(c) running edges;
(d) an upper strap;
(e) a lower strap; and a reinforcing frame which extends in the paddle region and/or in the rear end region, (f) wherein the reinforcing frame comprises: a left-hand side limb which extends in the longitudinal direction of the ski; a right-hand side limb which extends in the longitudinal direction of the ski; and a transverse limb which extends transverse to the longitudinal direction of the ski and connects the side limbs, and wherein the side limbs exhibit a limb distance from each other transverse to the longitudinal direction of the ski, and (g) wherein at least a part of the reinforcing frame is made of metal, and (h) wherein the reinforcing frame or the metal part of the reinforcing frame is punched or cut out of a film material or plate material made of an aluminium alloy.

24. A ski, comprising:

(a) a paddle region which forms a front end of the ski; a rear end region; and a binding region, which extends in the longitudinal direction of the ski between the paddle region and the rear end region, for fastening a ski binding;

(b) a core;

(c) running edges;

(d) an upper strap;

(e) a lower strap; and a reinforcing frame which extends in the paddle region and/or in the rear end region, (f) wherein the reinforcing frame comprises: a left-hand side limb which extends in the longitudinal direction of the ski; a right-hand side limb which extends in the longitudinal direction of the ski; and a transverse limb which extends transverse to the longitudinal direction of the ski and connects the side limbs, and wherein the side limbs exhibit a limb distance from each other transverse to the longitudinal direction of the ski, and (g) wherein at least a part of the reinforcing frame is made of metal, and (h) wherein the reinforcing frame is a light metal frame comprising a front reinforcing frame part and a separate rear reinforcing frame part, wherein the front reinforcing frame part and the rear reinforcing frame part are horseshoe-shaped.

* * * * *